United States Patent [19]

Letizia et al.

[11] Patent Number: 4,670,884

[45] Date of Patent: Jun. 2, 1987

[54] ROTATING CARBON OR GRAPHITE ELECTRODE COLUMN TO BE USED BOTH IN OPEN- AND SUBMERGED-ARC FURNACES

[76] Inventors: Italo Letizia, Voc. Vasciano 27, 05037 Stroncone (Terni); Maurizio Lezzerini, Via Turati 25, 05000 Terni, both of Italy

[21] Appl. No.: 776,897

[22] Filed: Sep. 17, 1985

[30] Foreign Application Priority Data

Sep. 18, 1984 [IT] Italy ..... 48864 A/84

[51] Int. Cl.[4] ..... H05B 7/103

[52] U.S. Cl. ..... 373/101; 373/94; 373/99

[58] Field of Search ..... 373/91, 52, 94, 92, 373/100, 96, 99, 101, 93

[56] References Cited

U.S. PATENT DOCUMENTS

| | | | |
|---|---|---|---|
| 3,377,686 | 4/1968 | Carpenter | 373/92 |
| 3,384,777 | 5/1968 | Sennewald et al. | 373/94 X |
| 3,420,939 | 1/1969 | Schlienger | 373/90 |
| 3,461,214 | 8/1969 | Schlienger | 373/90 |
| 3,937,867 | 2/1976 | Wynne | 373/92 |
| 4,044,199 | 8/1977 | Simon | 373/92 |

FOREIGN PATENT DOCUMENTS

| | | | |
|---|---|---|---|
| 44401 | 9/1956 | Fed. Rep. of Germany | 373/96 |

*Primary Examiner*—Roy N. Envall, Jr.
*Attorney, Agent, or Firm*—Brooks Haidt Haffner & Delahunty

[57] ABSTRACT

In an arc furnace both of the open-air and submerged arc type an electrode column able to perform angular movements in one or in both directions alternatively about its axis during furnace operations and, at the same time, it can be moved vertically so as to allow the tip level to be changed as usual, as it is necessary in the furnace operation to achieve the best electric arc.

7 Claims, 13 Drawing Figures

28
16
10
15
18
12
11
20
19
24
23
14
25
13
21
16
24
22
19
20
16
18
11
28
CE

CE
15
16
24
23
22
25
F
13
18
21
14

ROTATING CARBON OR GRAPHITE ELECTRODE COLUMN TO BE USED BOTH IN OPEN- AND SUBMERGED-ARC FURNACES

The subject of the present invention is a rotating electrode column made of graphite and/or carbon, which can be used both in open-arc furnaces, such as those commonly used for steel production, and submerged-arc furnaces, such as those generally used for producing silicon-metal, phosphorus, ferro-alloys and other materials.

The present invention can be applied to open-and submerged-arc furnaces operated at D.C. or A.C., using traditional carbon and/or graphite electrodes as well as to furnaces using water-cooled electrodes. It is well-known that in the field of steel production, the open-arc furnace technology has made great progress over the last years.

Detailed analyses on the production costs of steel have shown that the costs caused directly or indirectly by the electrode column consumption are about 8% of the total production costs.

The causes of consumption are the following:

(1) consumption due to oxidation of the electrode column;

(2) consumption of electrode tip due to;

(a) sublimation in the arc area;

(b) loss of small electrode pieces due to thermal stress in the arc area;

(c) oxidation;

(d) mechanical erosion;

(3) loss due to mechanical or thermo-mechanical causes;

(4) column breakage.

Some of these causes of consumption have become increasingly important with the increase of furnace power, arc length, and with the addition of fume exhausters and oxygen burners.

In spite of this, over the last years a constant decrease in electrode consumption has been obtained, especially through the improvement in electrode quality due to advanced production technologies and better raw materials employed (particularly, petroleum coke with a low coefficient of thermal expansion).

On the other hand, the technology of electric arc furnaces is now evolving as a result of lower tap-to-tap time and more uniform casting processes obtained by automation of the control system of the furnace parameters.

Now, the electrodes for electric steel production are joined into columns which make vertical automatic movements in order to maintain the arc, after the arc has been started, in the desired operative conditions. Such electrode columns are generally placed in each furnace at the vertices of an equilateral triangle, therefore the arcs at the tips of the three electrode columns repel each other due to electrodynamic forces, which drive the electric arcs towards the furnace walls.

This is a disadvantage, since the zone of the electrode column tip where the arc starts is mostly subject to consumption due to thermomechanical and chemical-physical causes, and since the sidewall refractory lining is damaged. In fact, practice has shown that in open arc furnaces an asymmetric consumption on the axis and a typical crack, which can be clearly seen in the enclosed drawings, may be observed on the electrode column tips after they have been operating for some time. Inside the crack, an atmosphere of ionized gas is formed; here the arc easily strikes and this, in turn, makes the crack deeper; this causes a higher electrode consumption due to sublimation and breakages.

The disadvantages decribed above cause damage to the electrode and decrease its efficiency and its operative life.

The present invention proposes to avoid the said disadvantages in order to limit the incidence of the electrode column cost on the operative cost of arc furnaces.

For this purpose, according to this invention, each electrode column is supported in such a way to allow it to move vertically on its axis, like in actual practice, and also to rotate around its axis. The rotation speed will be preferably 1–2 r.p.m., constant or variable; the rotation direction can be clockwise or counterclockwise, constant or alternate. Such a rotation prevents the tip from consuming itself asymmetrically, therefore giving it a higher mechanical strength, and assures an improved stability of the arc, which will no longer strike towards the furnace sidewalls.

This leads to:

(1) lower wear of the refractory lining of the furnace sidewalls;

(2) lower current and longer arc;

(3) more uniform casting, and therefore easier to programme;

(4) decreased oxidation and sublimation of electrode column tip due to the smaller area of the tip surface exposed;

(5) more symmetrical temperature distribution in the electrode column portions far from the tip, and radial (i.e., from the electrode axis towards its periphery) decrease of temperature gradient, which cause lower thermomechanical stresses in the electrode;

(6) more uniform current conduction in the contact clamp area;

(7) uniform oxidation consumption on the surface area of the electrode column; its consumption, therefore, is no longer localized, as happens when the electrode column is not rotated and burners, oxygen blowers and fume exhausters are used;

(8) improved arc stability, which allows operation at lower electrical reactance and, therefore, at a higher power factor; this turns into energy saving.

The portion of electrode column outside the furnace roof is also positively affected by rotation, since it distributes oxidation consumption on its surface area. In non-rotating electrode columns, such an oxidation consumption causes localized reduction on their section, resulting in lower mechanical strength.

Moreover, the rotation of the electrode column in the direction the electrodes are screwed together by means of nipples, prevents unscrewing of the electrode joint.

The present invention is also profitable in submerged-arc furnaces commonly used for producing silicon metal, phosphorus, ferro-alloys and other metal alloys, which use amorphous carbon electrodes.

Such furnaces are different from the electric steel furnaces, since the electrode columns are much larger in diameter and length and are equipped with two sets of clamps: contact clamps, placed near the charge so that the column portion affected by the current flow (and consequently by oxidation and thermomechanical stresses) is minimized; and holding clamps, placed some meters aboved the contact clamps.

The advantages obtained using the rotating electrode column according to our invention are the same as those of electric open-arc furnaces.

The invention will be now described with reference to the enclosed drawings, which show some examples of rotating electrode columns, both for open-and submerged-arc furnaces.

FIG. 1 shows an already existing furnace TF where in each of the existing electrode columns has been provided with a rotating system of the invention AA and AA' respectively.

FIG. 2 shows a non-rotating electrode column where the arc strikes towards the outside, i.e. towards the furnace refractory lining, which is therefore damaged.

Figure 2:
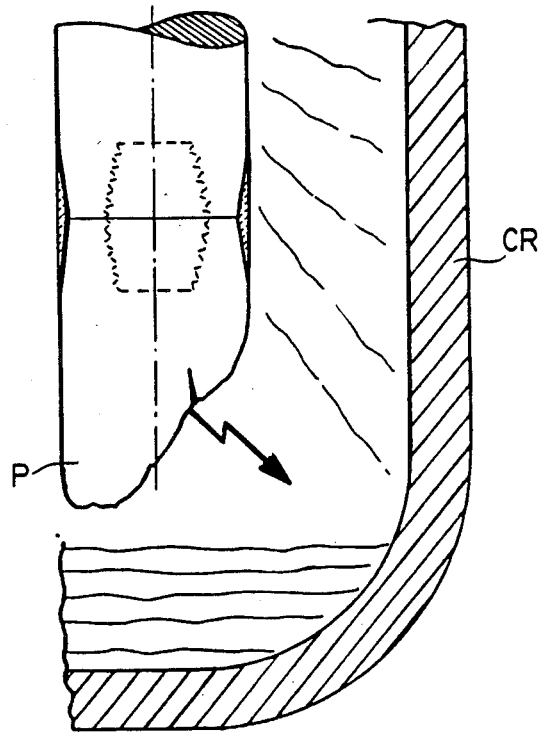
FIG. 2 shows a portion of an open-arc furnace and the lower end of a traditional electrode column (non-rotated) and the tip where the arc strikes.
Figure 2A:
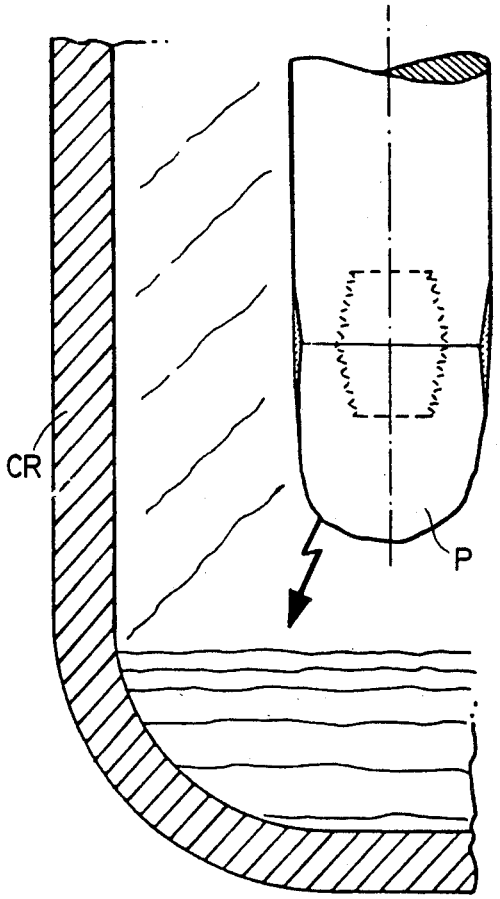
FIG. 2A shows the same portion of an open-arc furnace and electrode column in FIG. 2, but the electrode column is rotated according to the present invention.

FIG. 2 A shows a rotating electrode column according to the invention; the tip, of which where the arc strikes, is symmetrical to the axis and shows no cracks; the electrode column consumption is not localized and asymmetrical, but it is distributed in an annular way on its surface area; and the arc strikes towards the bath, instead of towards the furnace refractory lining, whose life will be improved.

Figure 3:
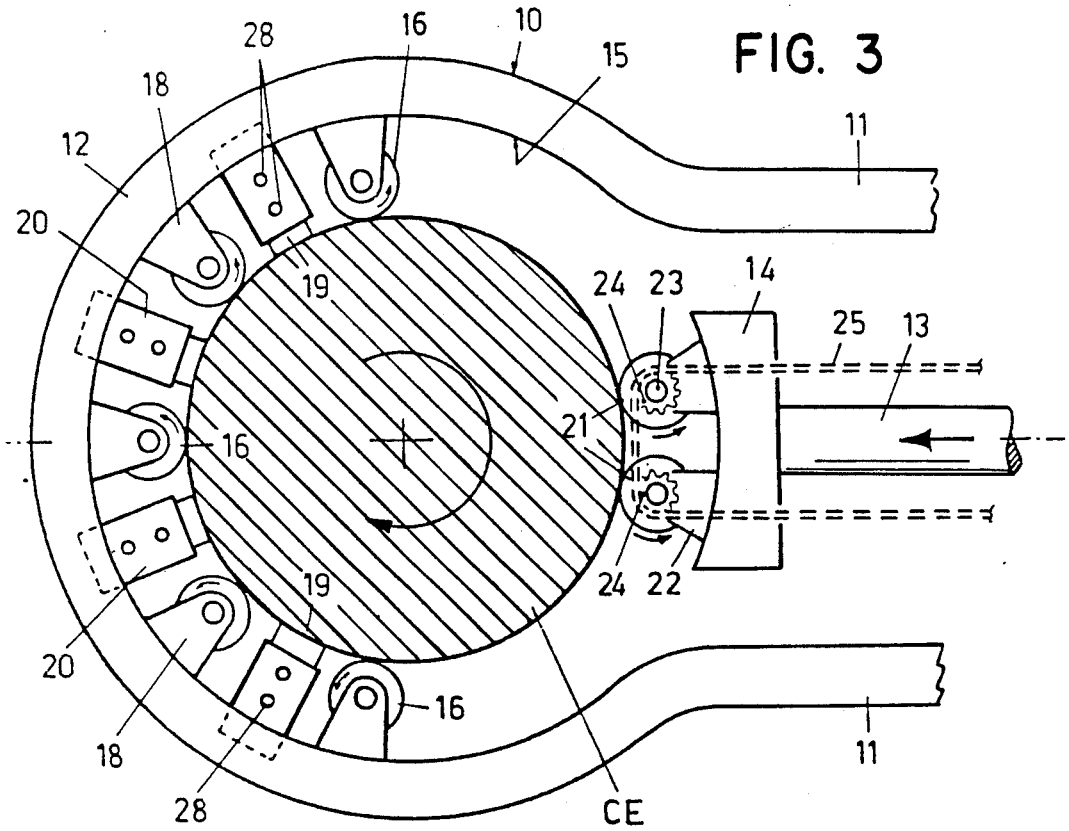
FIG. 3 shows means for rotating an electrode, particularly for electrode columns used in open arc furnaces.
Figure 4:
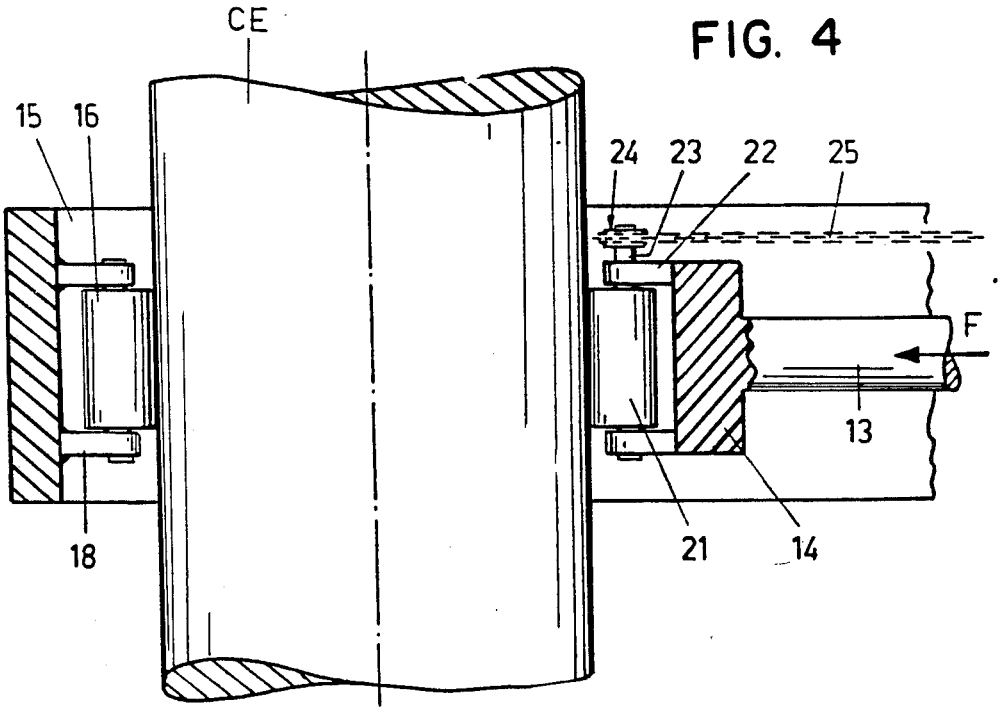
FIG. 4 shows an axial view of the device of FIG. 3.

FIGS. 3 and 4 show a rotating device for electrode columns according to this invention, particularly to be used in electric arc furnaces for steel production, with electrode columns up to about 700 mm. in diameter. Such a device is formed by a fixed bearing 10 comprising two parallel and spaced arms 11, a semi-annular head 12 and a thrusting device 13 between the two arms 11 and parallel to them, bearing a thrust head 14. The inner part 15 of the semi-annular head 12 bears several idle rollers 16 with their respective bearings 18, as well as several sliding contacts 19 kept in contact with the electrode column by means of springs, e.g. Belleville washers, with their respective cooled housings 20, alternately placed. Moreover, the thrust head 14 bears two motor rollers 21, each equipped with a bearing 22 and with an axis 23 where a gear wheel 24 is engaged. A gearing chain 25 is engaged to the two gear wheels 24; through this chain motion is given, coming from a reduction unit also equipped with a gear wheel, placed on the output shaft of a suitable motor (not shown). The bearing 13 is thrusted in the direction of arrow F by a suitable power system, e.g. a hydraulic system. The necessary vertical movement is given to the electrode column CE, as known, by the furnace arms supporting the fixed bearing 10 (not shown). Therefore, the electrode column CE is kept in an axial position in the semi-annular head 12 of the fixed bearing 10 against idle rollers 16 through the thrust exerted by the motor rollers 21 in the thrust head 14 of the thrusting device 13. The motor rollers 21 give, moreover, necessary rotation to the column CE, when they are moved by the reduction unit through the gearing chain 25 and gear wheel 24; additionally, the motor can be equipped with a speed variator and an alternator of the rotation direction. Current is conducted to the electrode column through the sliding contacts 19, elastically thrusted out of the cooled housings 20 by suitable springs. Housings 20 can be water-cooled, through inlet/outlet 28.

Figure 5:
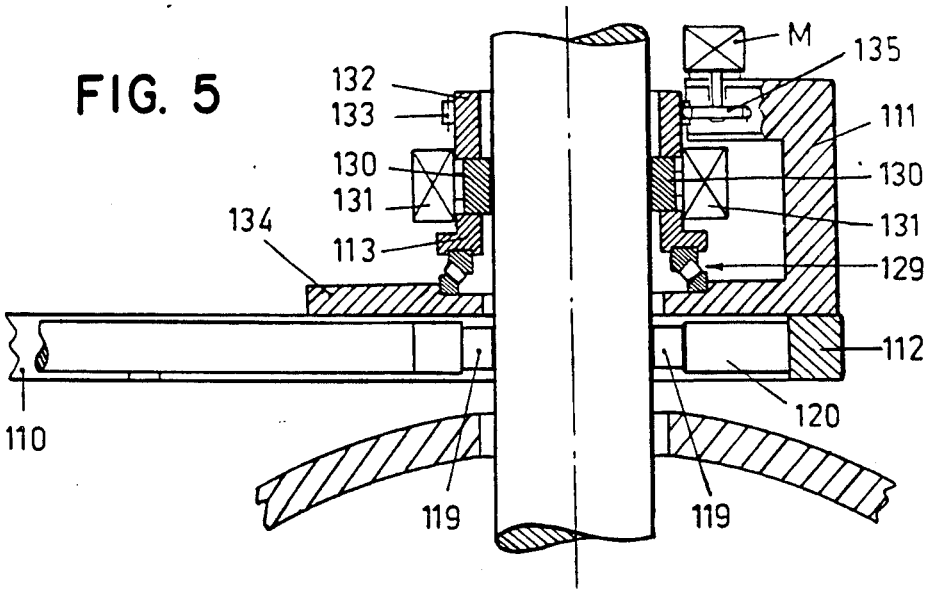
FIG. 5 shows an axial view of another way in which this invention can be applied for electrode columns in open-arc furnaces.
Figure 6:
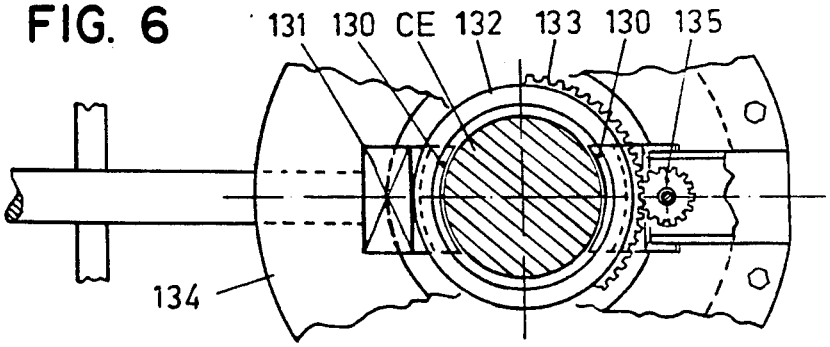
FIG. 6 shows a partial top view of the holding and rotating device shown in FIG. 5.

FIGS. 5 and 6 show, on a scale smaller than that of FIGS. 3 and 4, another way the present invention can be applied for use in open-arc furnaces with electrode columns of any size. Such a device includes, in addition to arms 110 connected through the semi-annular head 112, an annular bearing 134 and a cylindrical collar 113. The annular part 134 is equipped with a thrust block with well-known conical rollers 129, bearing the cylindrical collar 113 in such a way as it can be rotated.

The cylindrical collar 113 supports the electrode column CE through two jaws 130 which can be clamped onto it by means of suitable hydraulic or mechanical devices 131. Moreover, the cylindrical surface of the upper part 132 of the cylindrical collar 113 is equipped with a radial crown gear 133.

The annular bearing 134 supports, by means of a suitable L-shaped support 111, an electric motor M, which can be equipped with a speed variator and an alternator of the rotation direction, and a gear wheel 135 which, engaged to the crown gear 133, rotates the electrode column CE. Also in this case the current is conducted to the column CE through a set of sliding contacts 119 elastically thrusted against the column CE and supported as shown in FIGS. 3 and 4. Also the vertical movement of the column CE is the same as that mentioned for FIGS. 3 and 4.

Figure 1:
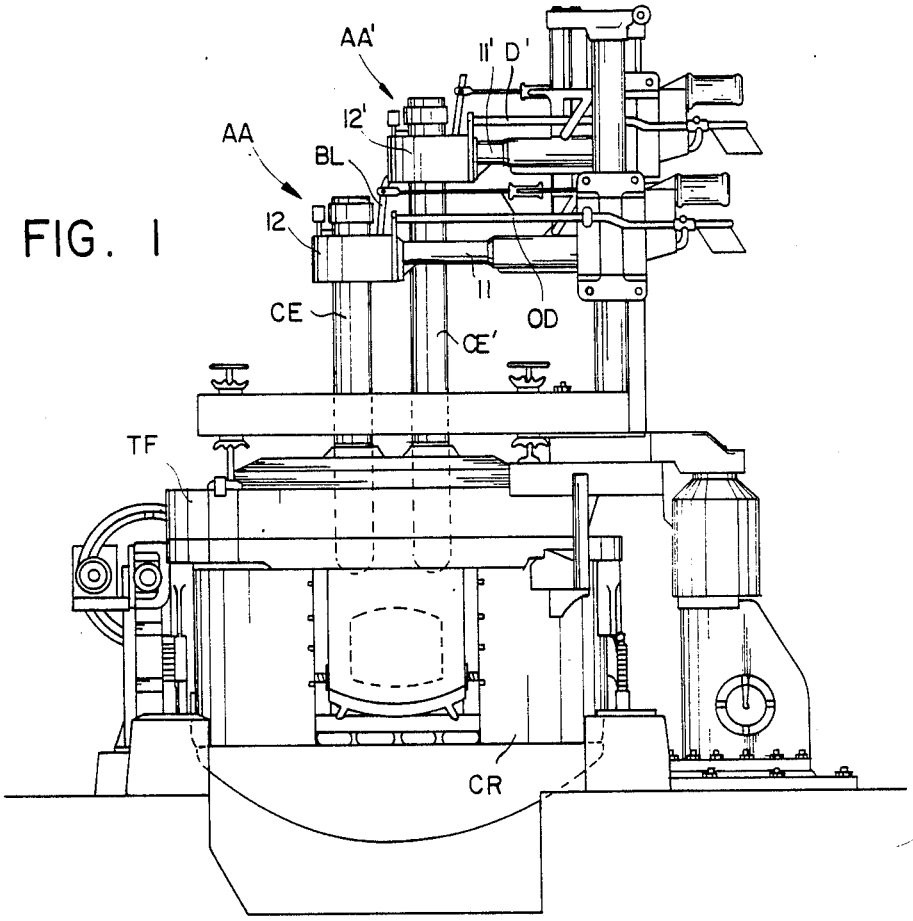
FIG. 1 is an elevation view of an existing furnace wherein the two operative electrode columns have been provided each with the column rotating system of the invention.
Figure 8:
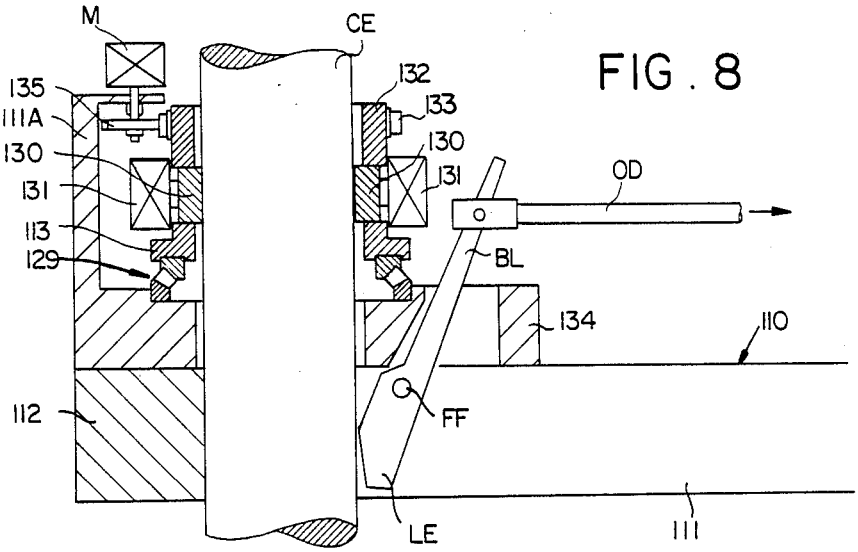
FIG. 8 shows more in detail and fragmentarily one of the systems of the furnace of FIG. 1.

FIG. 8 is a fragmentary view of FIG. 1 showing more in detail system AA intended to rotate electrode column CE the lower tip of which operates in crucible CR of furnace TF, that is of the already existing type, as explained above.

Figure 7:
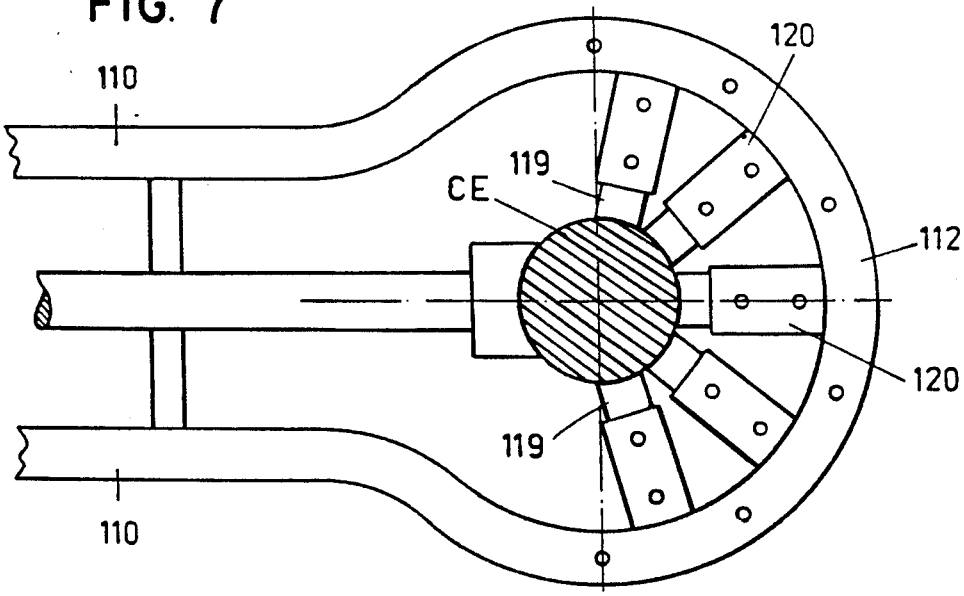
FIG. 7 shows a partial top view of the electrical contact device.

In this figure, the same references as utilized in FIGS. 5 to 7 have been used to indicate identical or similar parts.

As it will be evident to those skilled in the art arm 111 is the support arm which, in the existing furnaces is conveying the electric current to electrode column CE and supports the system of the furnace helding electrode column CE. This system comprises an oleodynamically operated link OD and a blocking lever BL, fulcrumed in FF, the lower end LE of which, when link OD is pulled in the direction of arrow F, blocks against vertical movements column CE by pressing the same against the inner surface of semiannular head 112, which surface is also the electric contact area between arm 111 and column CE.

As stated above, on arm 111 is installed the electrode column rotating system illustrated in FIGS. 5 to 7.

As known, in the existing furnaces arm 111 makes both short vertical movements which are necessary to continuously adjust the electric arc and relevant vertical movements, which are necessary to raise electrode column from the metallic bath in the crucible CR so that both collapsing of the furnace charge and the addition of additives to the bath, can occur.

According to the invention it is in connection with these relevant vertical movements of the electrode columns, during which the power supply to the columns is stopped, that the rotation of the electrode column is performed. To this aim jaws 130, which normally are released, are tightened against column CE, the pressure of lever BL is released by moving link OD in the opposite direction of arrow F and motor 131 is operated.

Through these operation electrode column CE can be rotated similarly to what has been already explained.

It is now mandatory to note that in this embodiment, as well as in all the embodiments of the invention, the benefits of rotating electrode column CE can also be achieved without rotating the same through complete revolutions since it can be sufficient to cause column CE to rotate each time through angular movements less than 360° both in one direction and in opposite directions, alternatively.

Figure 9:
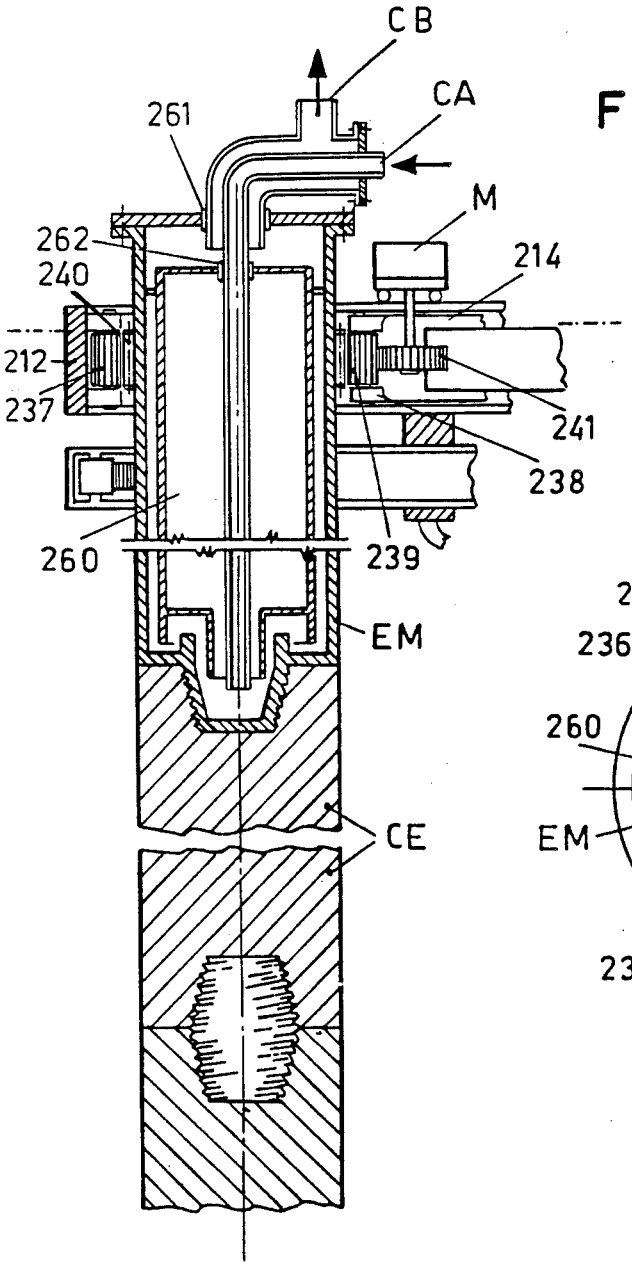
FIG. 9 shows an axial section of another way in which this invention can be applied for columns which include water-cooled electrodes.
Figure 10:
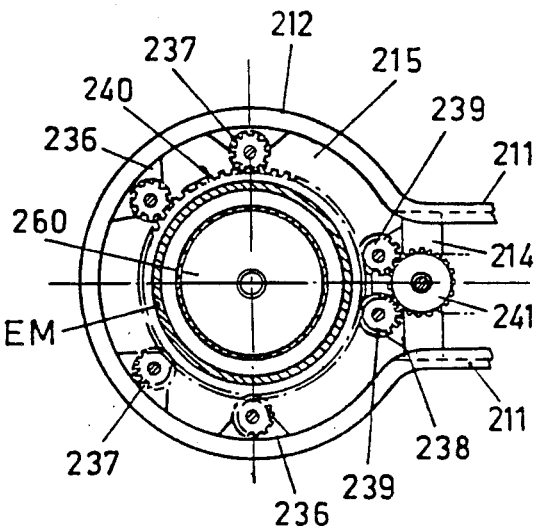
FIG. 10 shows a top view of the holding and rotating device shown in FIG. 9.

FIGS. 9 and 10 show a device to rotate an electrode column including a cooled metallic electrode. Such a device is similar to that described in FIGS. 3 and 4, but here the metallic electrode (known-type) is supported, and the following graphite electrodes forming the electrode column are screwed onto it. This device is formed by a bearing comprising two parallel and spaced arms 211, a semi-annular head 212 and a thrusting device 213 between the arms 211 and parallel to them, bearing a thrust head 214 whose ends slide on the arms 211, which drive it. The inner surface 215 of the semi-annular head 212 supports several idle gear wheels 237 by means of brackets 236. Moreover, the thrust head 214 bears two gear wheels 239 by means of supports 238.

The metallic electrode EM is equipped with a crown gear 240 integral to its surface area, engaged to the driving gear wheels 239 of the thrust head 214. The thrust head 214, moreover, bears an electric motor M which can be equipped with a speed variator and an alternator of the rotation direction, and a gear wheel 241 which, engaged to the gear wheels 239, rotates the electrode column CE.

As is known, cooling liquid can be circulated in the metallic electrode EM; it enters through the inlet I and comes out through the outlet O, both fixed (non-rotated). Well-known rotation seals 261 and 262 can be mounted on the metallic electrode EM. The cooled metallic electrode EM is held in its axial position inside the semi-annular head 212 of bearing 210 against the idle gear wheels 237 by the thrust exerted on it through the thrust head 214 of the thrusting device 213 by means of the gear wheels 239 which, moreover, give it the desired rotation, by means of driving gear wheels 241 engaged to motor M. Current is conducted to the electrode column through sliding contacts (not shown), as described previously. Vertical movement of the electrode column CE is the same as described for the previous figures.

Figure 11:
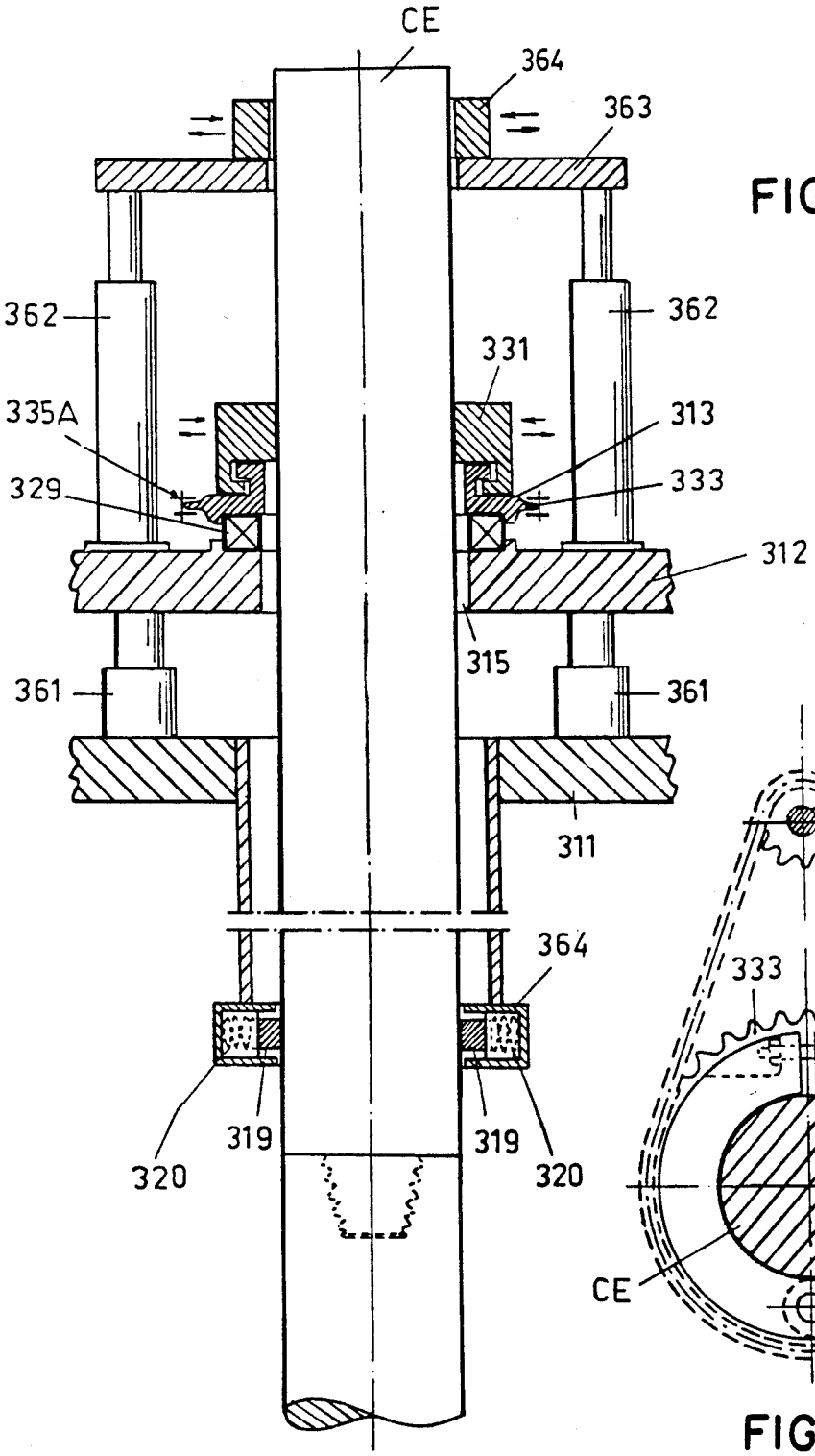
FIG. 11 shows an axial section of a way in which the present invention can be applied for electrode columns used in submerged-arc furnaces.
Figure 12:
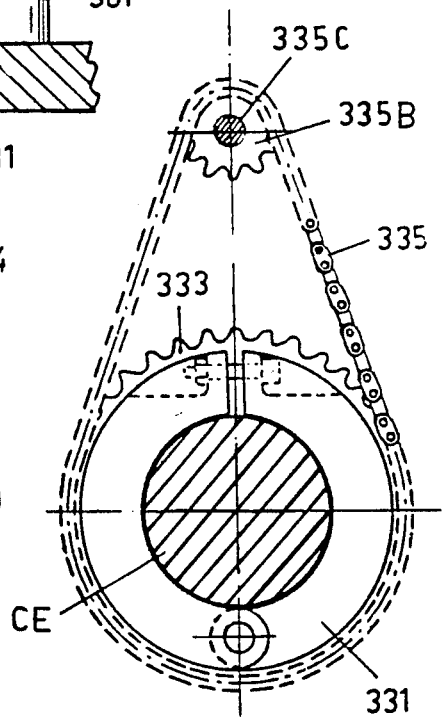
FIG. 12 shows a partial top view of the holding and rotating device shown in FIG. 11.

FIGS. 11 and 12 show a way of using this invention suitable for submerged-arc furnaces. The device comprises a main plate 312 which can be moved vertically, having a central hole 315 where the electrode column CE can be placed; a first set of hydraulic cylinder-and-piston systems 361, of which only two can be seen in FIG. 10, bearing the main plate 312 on the supporting floor 311 of the whole device; a cylindrical collar 313 provided with a vice 331 to clamp the electrode column CE; another set of hydraulic cylinder-and-piston systems 362, of which only two can be seen in FIG. 10, which allows a secondary plate 363 provided with vices 364 to clamp the column CE to be moved vertically. As has been shown for the device in FIGS. 5, 6 and 7, the cylindrical collar 313 is supported so that it can be rotated on the main plate 312 by a thrust block with conical rollers 329, of well-known type.

The rotation movement is transmitted to the electrode column CE in the same way as in FIGS. 5 and 6; in fact, the outer surface area of the cylindrical collar 313 is integral to a radial crown gear 333; however, it is engaged to a gearing chain 335 A moved by a sprocket wheel 335 B (FIG. 11) of which the axis 335 C is the output of a reduction unit run by an electric motor (not shown), which can be equipped with a speed variator and an alternator of the rotation direction.

Since this transmission is well-known and its operation can be easily realized, it will be no longer described. During operation, the marked vertical movements of the electrode column are carried out through the hydraulic systems 362 by stopping the movement given by the electric motor, opening the operative vice normally clamped, and clamping the vice 364 normally open.

The small vertical movements necessary during furnace operation are carried out by means of the hydraulic systems 361 and there is no need to stop the rotation of electrode column EC.

The contact clamps, which in submerged-arc furnaces are very close to the charge, and therefore under the plane 311, are replaced by sliding contacts 319 placed in housings 320, which can be cooled; they are thrusted against the electrode column EC by Belleville washers (not shown). The current is conducted to the container 364 through conductors (not shown).

We claim:

1. A supporting device for rotating an electrode column for an arc furnace comprising a bearing means suitable to bear the electrode column weight, said bearing means comprising a semi-annular, partially open head, said bearing means being spaced a distance at least partially around and from said electrode;

support means suitable for operating together and at the same time with said bearing means, so that said means can support the electrode column and at the same time allow the electrode column to rotate around its axis, said support means located within the semi-annular spaced distance of the partially open head of said bearing means and between said bearing means and said electrode;

means for rotating said electrode column; and means for conducting an electric current to said electrode column, while the electrode column is rotating, said conducting means also located within the semi-annular spaced distance of the partially open head of said bearing means, and between said bearing means and said electrode, with said conducting means adjacent to said support means.

2. The device of claim 1, further comprising means for moveable supporting said bearing means, so that the bearing means can make small vertical movement.

3. The device of claim 1, wherein said semi-annular, partially open head of said bearing means has on its inner surface idle supported rollers, two radial parallel arms supporting said semi-annular head; and a movable thrusting head between said arms and parallel thereto, driven by a thrusting hydraulic means, and with its surface facing the semi-annular head provided with two thrusting rollers having axes parallel to those of said idle rollers, said electrode column being supported inside said semi-annular head by said thrusting head, which keeps the electrode column against said idle rollers which, together with the thrusting rollers, allow the column to be rotated.

4. The device of claim 3, wherein said thrusting rollers, which are also the means by which the electrode column can be rotated, are rotated by an electric motor through a mechanical transmission means, so that the electrode column is rotated due to the friction between its cylindrical surface area and said mechanical transmission means.

5. The device of claim 1, wherein said bearing means comprises a semi-annular head suitable to house said electrode column and provided with jaws adapted to make said bearing integral with the electrode column;

a "fifth wheel" integrated with said semi-annular head; and conical rollers placed between two "fifth wheels" so that the electrode column, supported by the semi-annular head, can be rotated inside them.

6. The device of claim 5, further comprising a radial crown gear integrated with a cylindrical collar, a gear wheel the axis of which is carried by said semi-annular head, and said motor connected to said gear wheel through said mechanical transmission so that it gives to such a wheel, and therefore to the combination of radial crown gear, cylindrical collar, electrode column, the motor rotation, so that the electrode column may be rotated inside said semi-annular head.

7. The device of claim 1, wherein said electric current conducting means and said support means are alternatively placed within said semi-annular spaced distance of said bearing means.

* * * * *